US006158616A

United States Patent [19]

Huang

[11] Patent Number: 6,158,616

[45] Date of Patent: Dec. 12, 2000

[54] CUTTER BLADE DISPENSER AND DISPOSER WITH SLIDE BIASING MEANS AND SIDE LOCATED DISPENSING SLOT

[76] Inventor: Yin-Hae Huang, NO.56, Min Sheng Street, Feng-Yuan City 42041, Taiwan

[21] Appl. No.: 09/384,697

[22] Filed: Aug. 26, 1999

[51] Int. Cl.[7] ..... A47F 1/00; B65H 1/08; B65H 3/00

[52] U.S. Cl. ..... 221/268; 221/102; 221/268; 221/270

[58] Field of Search ..... 221/185, 226, 221/228, 232, 236, 268, 270, 269, 279, 102; 206/16

[56] References Cited

U.S. PATENT DOCUMENTS

| | | | |
|---|---|---|---|
| 2,567,230 | 9/1951 | Muros | 206/16 |
| 2,680,291 | 6/1954 | Shnitzler et al. | 30/40 |
| 2,889,076 | 6/1959 | Schie | 221/232 |
| 3,764,040 | 10/1973 | Solomon | 221/76 |
| 3,767,083 | 10/1973 | Webb | 221/279 |
| 3,850,343 | 11/1974 | Petrillo | 221/102 |
| 3,869,066 | 3/1975 | Ferraro | 221/102 |
| 3,910,455 | 10/1975 | Ferraro | 221/102 |
| 3,941,244 | 3/1976 | Braginetz | 206/360 |
| 4,114,780 | 9/1978 | Sharon | 221/101 |
| 4,826,042 | 5/1989 | Vujovich | 221/228 |
| 4,850,512 | 7/1989 | Vujovich | 221/232 |
| 4,978,031 | 12/1990 | Lembke | 221/102 |
| 5,251,783 | 10/1993 | Gringer | 221/102 |

FOREIGN PATENT DOCUMENTS

| | | | |
|---|---|---|---|
| 732031 | 4/1966 | Canada | 221/102 |
| 1 458387 | 3/1969 | Germany | 221/102 |
| 24 38 524 | 8/1974 | Germany | 221/102 |

*Primary Examiner*—Christopher P. Ellis
*Assistant Examiner*—Michael E. Butler

[57] ABSTRACT

A cutter blade dispenser and disposer with slide biasing means and side located dispensing slot comprising a body, a sliding block and a side compartment. The body is a trapezium case and can room a plurality of blades, an elongate slit rail is disposed on top of the body, inside the body has a pillar for an elastic element to sleeve on, an elastic block is disposed on top of the opening of the body. The sliding block is in trapezium shape for fitting inside the body with an inclined piece and a pressing block disposed on its top. The side compartment is also in trapezium shape and can cover the opening of the body, a locking hole is disposed on top of the side compartment with a sliding hole and an elongate slit on its one side. The sliding hole and the elongate slit are in one through passage. A storage board is disposed underneath the sliding block and inside on the bottom of the body. The storage board has a protrusion bar on its each side for placing the blades in decency and order. A plurality of protruded pieces are disposed on one end of the storage board to limit and stop the sliding block. Accordingly, put the sliding block inside the body and slide it so that the sliding block bounces back out because of the elasticity provided by the elastic element. The storage board is then being pushed outside the opening of the body to a distance, the storage board can be pulled more outside for placing the blades. Thus to achieve the purpose of more convenient and safer storage and disposal of said blades.

9 Claims, 9 Drawing Sheets

CUTTER BLADE DISPENSER AND DISPOSER WITH SLIDE BIASING MEANS AND SIDE LOCATED DISPENSING SLOT

BACKGROUND OF THE INVENTION

The present invention relates to cutter and more particularly to a cutter blade dispenser and disposer with slide biasing means and side located dispensing slot for safer storage of cutter blades as well as more convenient of loading and disposing cutter blades.

Typical heavy-duty cutter has double sides of blades in trapezium shape, which is different from the type that the blades are connected to one another, if the one in the front is not sharp any more, user can change to a new one by breaking the old one off from the long connected row of blades. The typical one usually comes in a package with a certain number of blades, user then stores a pile of blades in cartridge of cutter ready for use. As shown in FIG. 9, which mainly consists a body 10 and an upper cover 14. The body 10 is a flat block with a hanging hole 11, each of its two sides has a rail 12 to fit in a griping block 142 of the upper cover 14. Each of two parallel sliding slits 13 on the body 10 is for a tenon 161 of a sliding block 16 to indent and slide through. The body 10 also has parallel trough pattern 141 for positioning of blades 17. Each end of the upper cover 14 has a anti-direction sliding hole 18 and 191, the sliding hole 191 has a slit opening 19 for sliding out the blade 17. The sliding hole 18 also has a slit opening (which is not shown in the figure) for storage of used blades. Accordingly, one end is for new blades to slide out for usage and another end is for storage of used blades. The sliding block 16 separates the new blades from the used ones. When more used blades are stored through the sliding hole 18 and pushes the sliding block 16 towards the sliding hole 191, thus forces a new blade slide out from the slit opening 19 for usage. Another way is to push the sliding block 16 towards the sliding hole 191 by hand to force the blade 17 to line up with the slit opening 19, then slide the blade 17 out from the slit opening 19 by pushing from the sliding hole 191 with finger.

Usually, users will dispose used blades instead of putting them back to cartridge, therefore the most common way of sliding out the blade 17 is mainly by pushing the sliding block 16 which sometimes could get stuck and not very smooth.

Furthermore, it is not convenient to take the upper cover 14 apart from the body 10. The blades that are stored in cartridge could easily be messed up when try to put the upper cover 14 back, thus it is a hassle for users to have to arrange the blades in order again. Even though the blades are smooth on surface, it is still difficult to slide out for usage because of the pressure against the upper cover 14. Users could easily get hurt if not handle with care. Another drawback is that users sometimes can not tell which are used ones or new ones.

SUMMARY OF THE PRESENT INVENTION

The present invention has a main objective to provide a cutter blade dispenser and disposer with slide biasing means and side located dispensing slot for users to easily and conveniently store blades in decently and orderly, also to provide a flat sliding board, which can be slide out by elasticity of a sliding block for storage of single or packaged blades. It is not only convenient, but is also a safer mechanism for storage and disposal of blades.

The present invention will become more fully understood by reference to the following detailed description thereof when read in conjunction with the attached drawings.

BRIEF DESCRIPTION THE DRAWINGS

Figure 2:
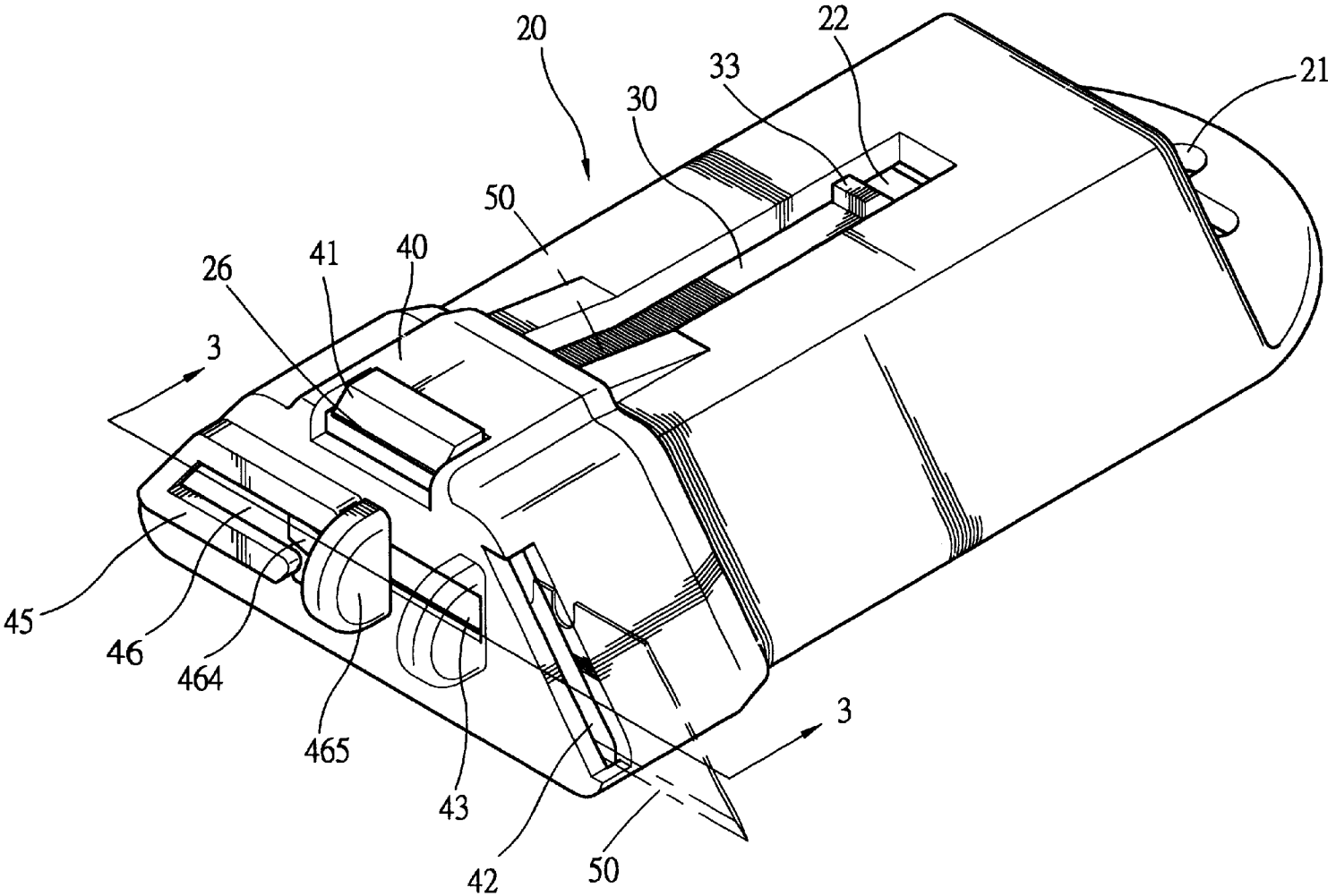
FIG. 2 is a perspective view of the present invention.
Figure 3:
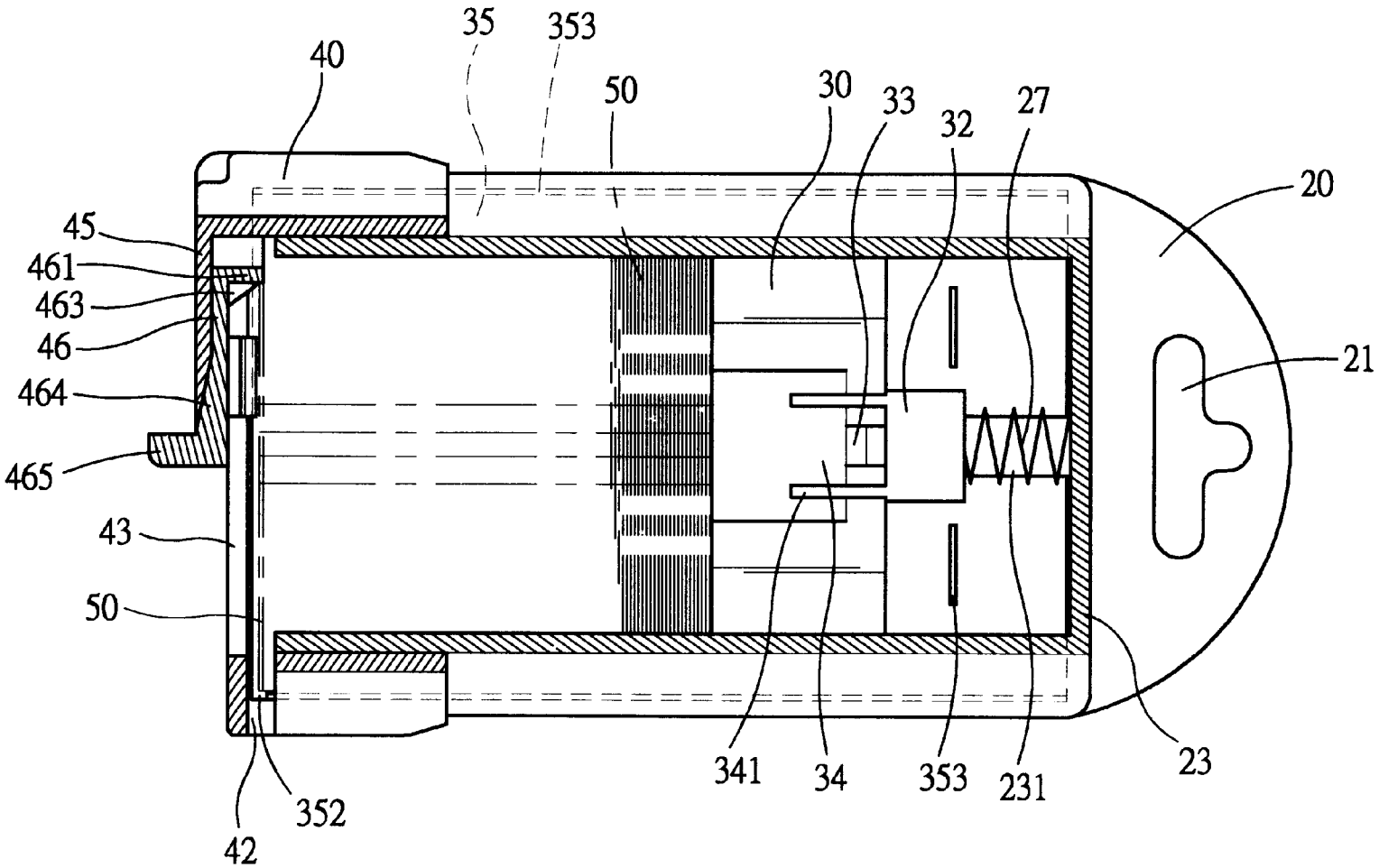
Figure 4:
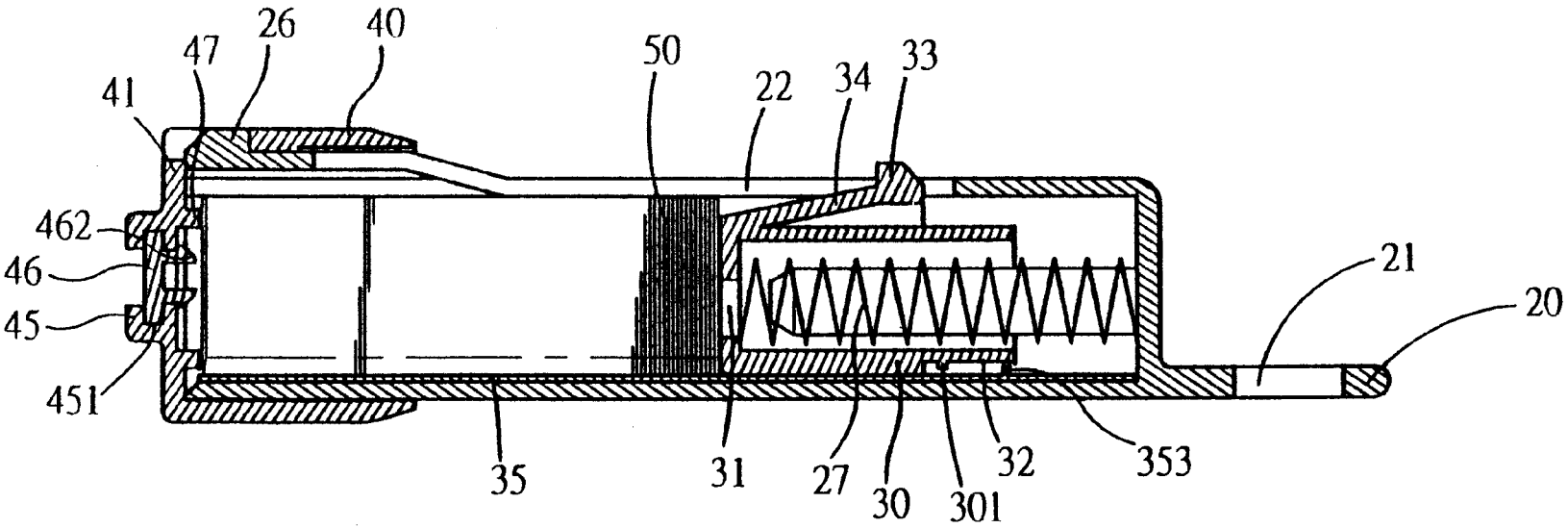
Figure 5:
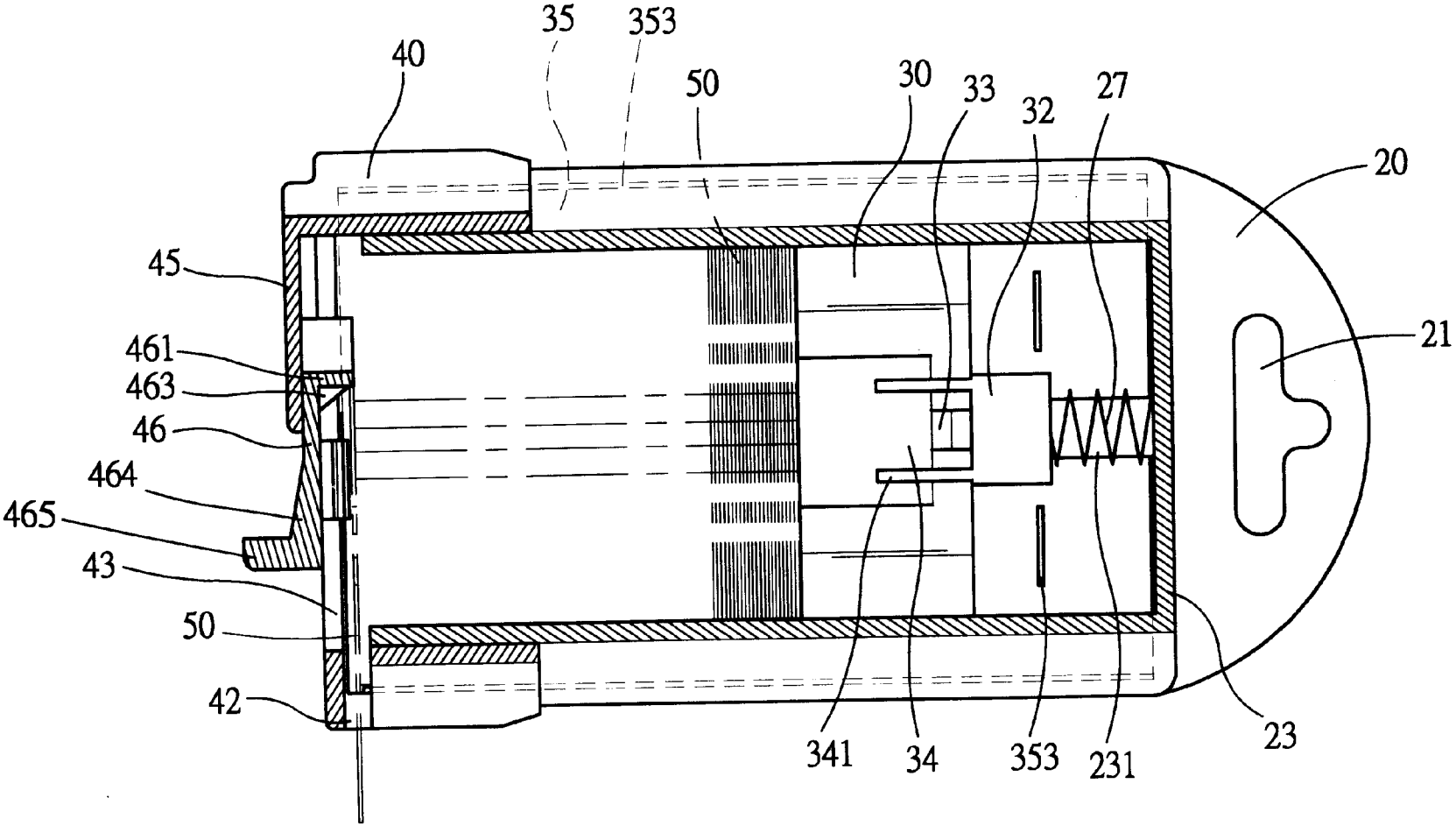
Figure 6:
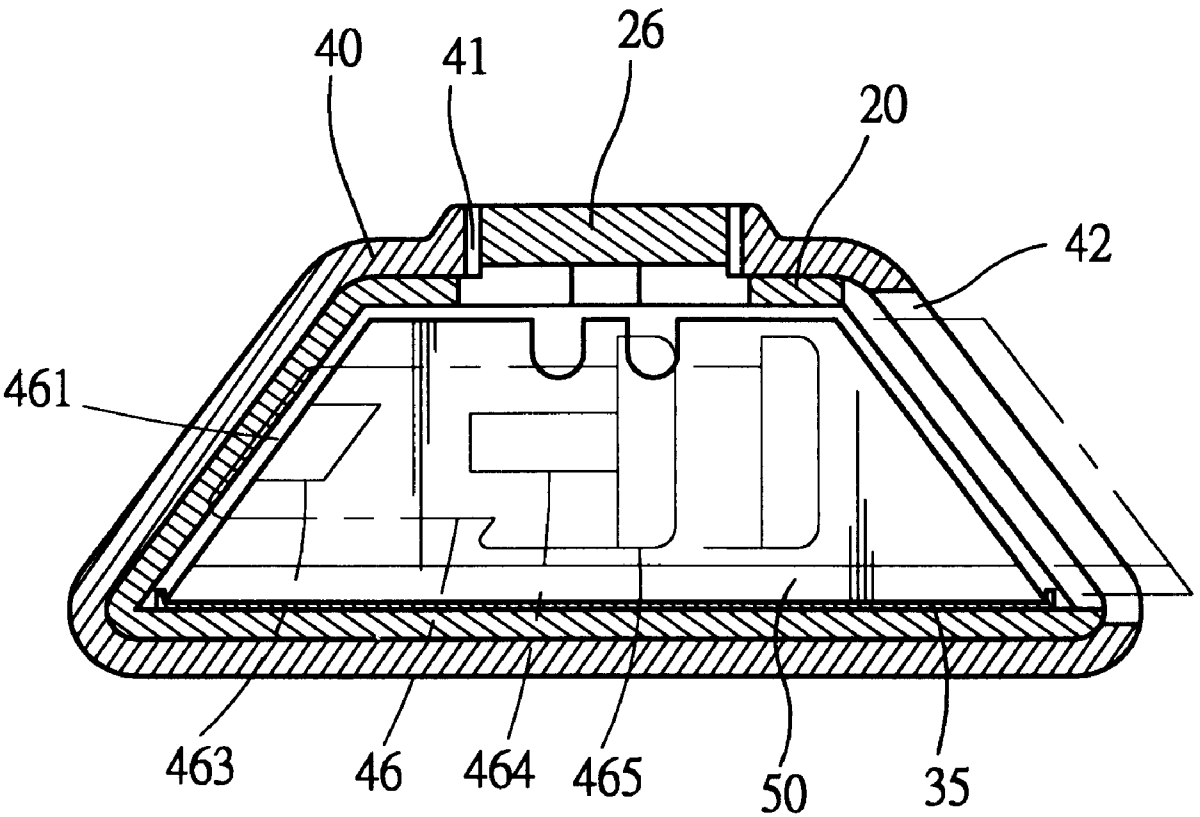
Figure 7:
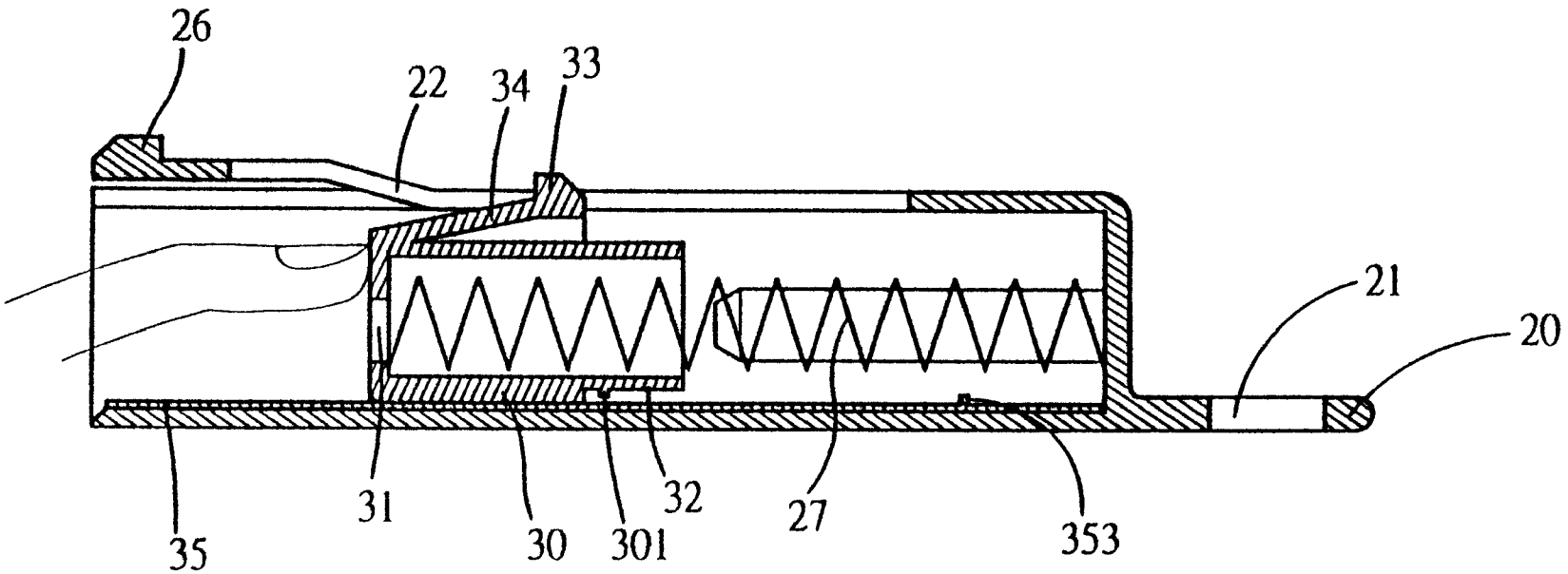
Figure 8:
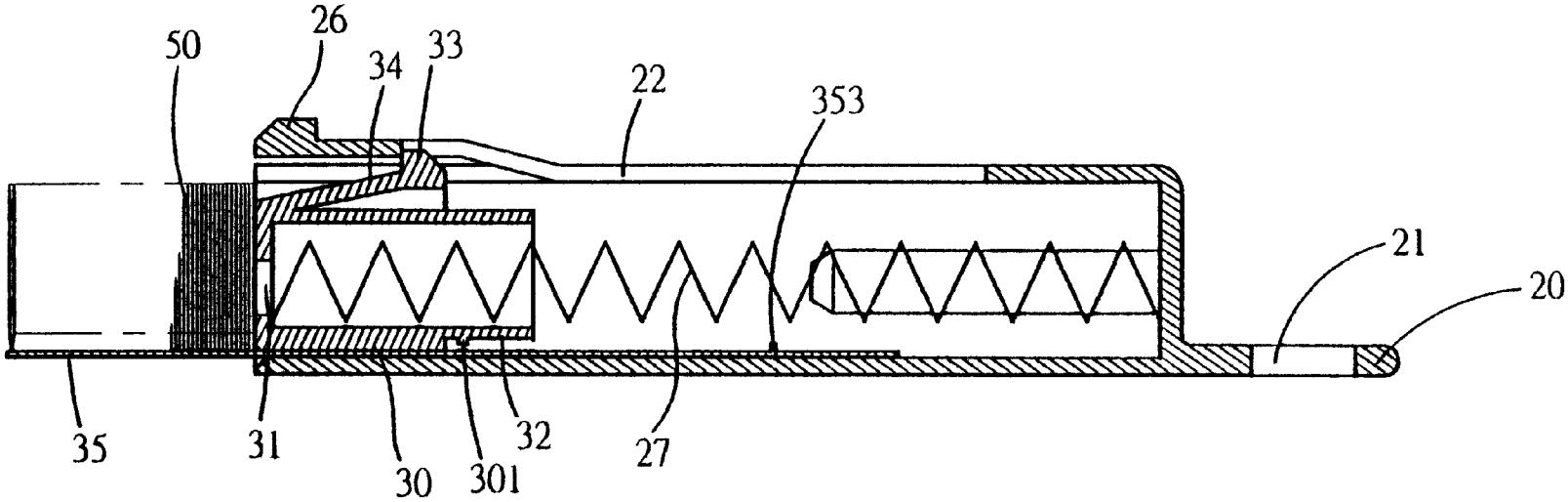
Figure 9:
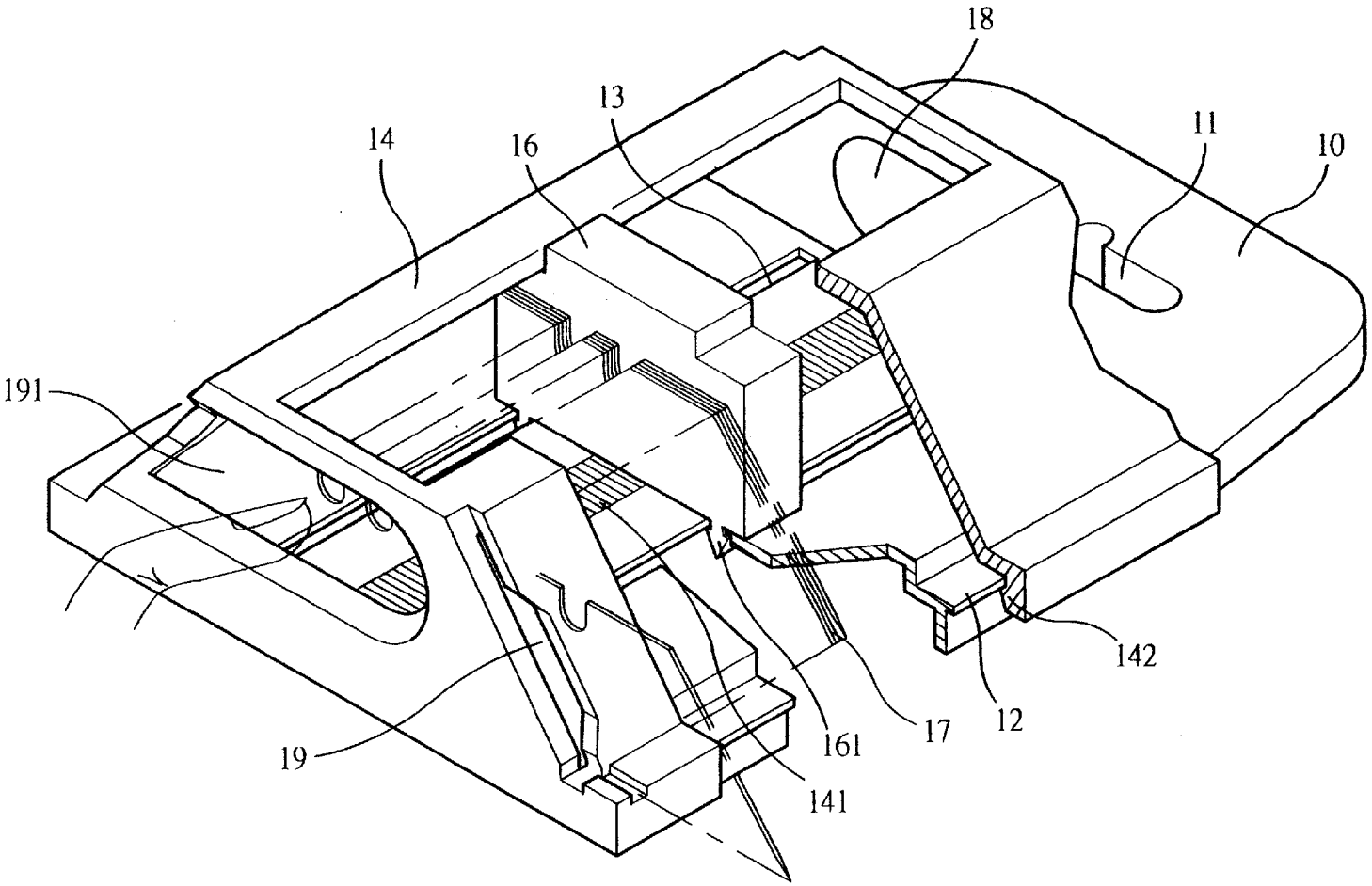
FIG.9 (Prior Art)

FIG. 3 is a sectional view of FIG. 2 when being dissected at plane 3—3, FIG. 4 is a sectional view the present invention when the pressing block of the sliding block is away from the positioning hole and pushes the blade, FIG. 5 is a sectional view of the present invention when the pushing piece pushes the blade out from the slit opening, FIG. 6 is a side plane view of the present invention when the pushing piece pushes the blade, FIG. 7 is a sectional view of the present invention when the sliding block is pushed inside the body before assembly of the side compartment, FIG. 8 is a sectional view of the present invention when the storage board is in a ready-to-load blades position after the sliding block returns to its original position, and FIG. 9 is a perspective view of a typical cutter with a blade cartridge.

DETAILED DESCRIPTION OF THE PREFERRED EMBODIMENT

Figure 1:
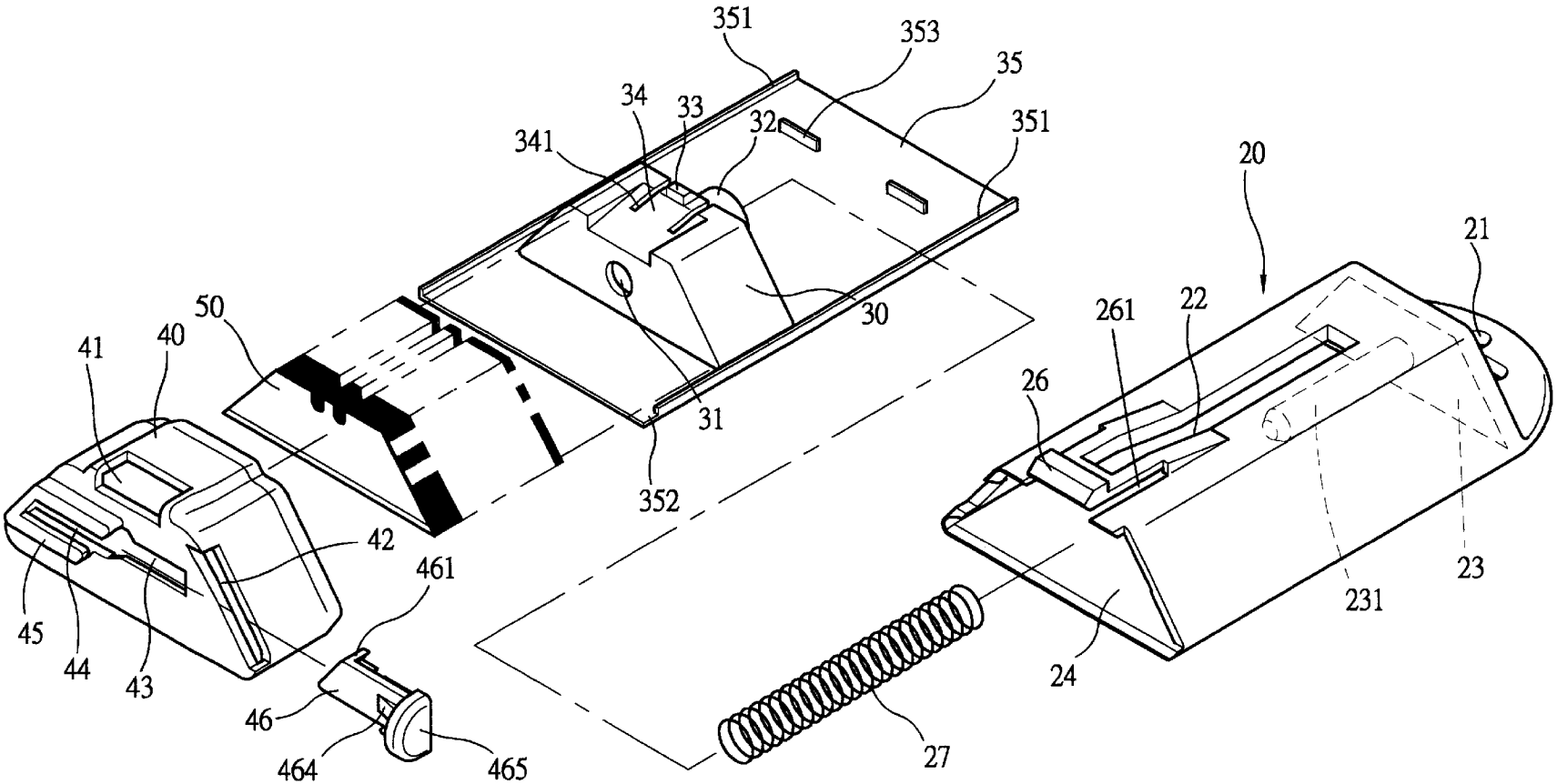
FIG. 1 is an exploded perspective view of the present invention.

With reference to FIGS. 1, 2 and 4, the present invention of a structurally improved cutter cartridge generally comprises a body 20, a sliding block 30 and a side compartment 40. The body 20 is a case with a trapezium space for storage of blades 50, its trapezium space is defined by a closed end 23 at one end and an opening 24 at another end. A pillar 231 is disposed on the closed end 23 pointing towards the opening 24, the pillar 231 is for an elastic element 27 to sleeve on. The body 20 has a hanging hole 21 at one end and an elongate slit rail 22 on its top plane. An elastic block 26 is disposed on top of the opening 24, the elastic block 26 has a slit 261 on its each side to provide elasticity for the elastic block 26 to return to its original position. The sliding block 30 is a hollow trapezium with a hollow positioning pillar 32 on one end and a hole 31 on the other end. The hollow positioning pillar 32 can sleeve on the pillar 231 of the body 20, while the elastic element 27 is enclosed inside the hollow positioning pillar 32 and pressed against the hole 31. An inclined piece 34 with a slit 341 on its each side is disposed on top of the sliding block 30. The inclined piece 34 has a pressing block 33 on its top for sliding into the slit rail 22 of the body 20. The sliding block 30 has a concave surface 301 on its bottom. The side compartment 40 has a closed end and an opened end, it is just a little bigger than the opening 24 of the body 20 to sleeve on it. A locking hole 41 is disposed on top of the side compartment 40 for inserting the elastic block 26 of the body 20, so that the side compartment 40 is locked together with the body 20 on its one end. A sliding hole 43 on the same line through an elongate slit 44 is disposed on the closed end of the side compartment 40, the elongate slit 44 is wider than the sliding hole 43. Protection bars 45 are disposed on top and under the elongate slit 44 respectively, the lower side of the top protection bar 45 and the upper side of the bottom protection bar 45 each has a trough 451, two cushioning bars 47 are disposed inside the side compartment 40 (as shown in FIG. 4). A blade slit opening 42 is disposed at one corner side of the side compartment 40. A pushing piece 46 is inserted in between the troughs 451 of the protection bars 45, two arrow-shaped tenons 462 are disposed on the inner side of the pushing piece 46 for inserting into the sliding hole 43 so that the pushing piece 46 can be slide inside the sliding hole 43. When the pushing piece 46 is inside the elongate slit 44, it can slide in between the troughs 451. An inclined side piece 461 is extended from one end of the pushing piece 46, its inclined angle degree is the same as the one of a blade 50 for closer and firmer contact as well as more stable sliding and pushing. A strengthen rib 463 is disposed between the side piece 461 and the pushing piece 46. The pushing piece 46 also has a gripping piece 465 on the opposite end to the side piece 461, another strengthen rib 464 is just by the gripping piece 465 for strengthen purpose. A storage board 35 can be placed between the inner bottom of the body 20 and the sliding block 30. The storage board 35 has protrusion bar 351 on each side. An indentation 352 is disposed on the protrusion bar 351 in correspondent to the blade slit opening 42 of the side compartment 40 so that the blade 50 can be slide out the blade slit opening 42 through the indentation 352. Two protruded pieces 353 are disposed on the upper side at one end of the storage board 35 so that the storage board 35 can be stopped by the concave surface 301 of the sliding block 30.

Accordingly and as shown in FIG. 5, first put the elastic element 27 inside the hollow positioning pillar 32 of the sliding block 30, then insert the storage board 35 on top of the inner bottom of the body 20, next place the sliding block 30 inside the body 20 all the way to the closed end 23, the elastic element 27 can sleeve on the pillar 231 of the body 20. As shown in FIGS. 7 and 8, if want to place blades 50, first push the sliding block 30 inside the body 20 and it will bounces back out because of the elasticity provided by the elastic element 27, thus the storage board 35 is pushed outside the opening 24 of the body 20 because of the abrasion between the storage board 35 and the sliding block 30, the storage board 35 can then be pulled out manually to desire protruded length. Meanwhile, the storage board 35 can also be stopped when the protruded pieces 353 meet the concave surface 301 of the sliding block 30. Then the blades 50 can be placed on the storage board 35 and are defined by the protrusion bars 351 decently and orderly. Finally, sleeve the side compartment 40 on the opening 24 of the body 20 in such a way that the locking hole 41 is locked together with the elastic block 26. What happens inside is that the side compartment 40 and the blades 50 pushes the sliding block 30 to a certain distance, then the sliding block 30 bounces back out against the blades 50 because of the elasticity provided by the elastic element 27. The amount of the blades 50 in storage can also be easily seen through the elongate slit rail 22.

Referring to FIGS. 3 and 5, when the blades 50 are pushed by the sliding block 30, the blades 50 are stopped by the cushioning bars 47 inside the side compartment 40 (as shown in FIG. 4), so that only a little part of the front inner side of the side piece 461 of the pushing piece 46 touches a single blade 50, then push the gripping piece 465 manually to slide the side piece 461 from the elongate slit 44 to the sliding hole 43. Lastly, push a blade 50 out through the blade slit opening 42 by using the side piece 461, the pushing piece 46 can also be pushed back for disposal of another blade 50 later when needed.

The present invention can install or dispose a single or a whole package of blades 50 conveniently, smoothly, quickly and safely, can also ensure that only a single blade 50 is slide out through the blade slit opening 42, free from the drawbacks of getting stuck or few blades come out all together. The storage board 35 can be easily slide out by the abrasion between itself and the sliding block 30 when the latter one is pushed back out by the elasticity provided by the elastic element 27. The mechanism is just as simple and easy as like a drawer for storing or disposing the blades 50 and keeping them in decency and order.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A cutter blade dispenser and disposer with slide biasing means and side located dispensing slot comprising:

a body, a sliding block and a side compartment, said body is a case with a trapezium space for storage of a plurality of blades and the trapezium space is defined by a closure at one end and an opening at another end, an elongate slit rail is disposed on top of said body, inside said body has a pillar for an elastic element to sleeve on, an elastic block is disposed on top of the opening of said body, said sliding block is in trapezium shape for fitting inside said body, a hole penetrates through said sliding block with an inclined piece and a pressing block on said sliding block's top, said side compartment is also in trapezium shape and can cover said opening at one end of said body, a locking hole is disposed on top of said side compartment with a sliding hole and an elongate slit on the trapezium shape plane of said slide compartment, which said sliding hole and elongate slit are in one through passage, said elongate slit has an upper as well as a lower protection bar and is wider than said sliding hole, a pushing piece can slide through said elongate slit and said sliding hole, said pushing piece has a plurality of arrow-shaped tenons for sliding inside said sliding hole, said elongate slit, a side piece is extended from said pushing piece, said side compartment has a blade slit opening, a storage board is disposed underneath said sliding block and inside on the bottom of said body, said storage board has a protrusion bar on its each side to place said blades in decency and order, a plurality of protruded pieces are disposed on one end of said storage board to limit and stop said sliding block, accordingly, put said sliding block inside said body and slide it so that sliding block is biased back because of the elasticity provided by said elastic element, said storage board is then being pushed outside said opening at one end of said body, said storage board can be pulled more outside for placing said blades, said side compartment can cover said opening said opening at one end of said body, thus to achieve the purpose of more convenient and safer storage and disposal of said blades.

2. A structurally improved cutter cartridge as claimed in claim 1 wherein a slit is disposed by each side of said inclined piece on said sliding block to provide a flexible cantilever for said inclined piece to return to original position, said pressing block on said inclined piece can lock into said locking hole or slide through said elongate slit rail.

3. A structurally improved cutter cartridge as claimed in claim 1 wherein an elastic block on said body has a slit by each side forming a flexible cantilever capable of locking inside said locking hole of said side compartment.

4. A structurally improved cutter cartridge as claimed in claim 1 wherein each of said protection bars of said side compartment has a trough facing towards each other for said pushing piece to slide inside.

5. A structurally improved cutter cartridge as claimed in claim 1 wherein said side piece of said pushing piece is inclined so as to just fit the angle degree of said blades.

6. A structurally improved cutter cartridge as claimed in claim 1 wherein said pushing piece has a gripping piece for convenience of pushing said pushing piece.

7. A structurally improved cutter cartridge as claimed in claim 1 wherein a plurality of cushioning bars are disposed inside on the upper and lower side of said elongate slit and said sliding hole of said side compartment for said pushing piece to push out said blades.

8. A structurally improved cutter cartridge as claimed in claim 1 wherein one of said protrusion bars has an indentation in correspondent to said blade slit opening of said side compartment for said blades to come through.

9. A structurally improved cutter cartridge as claimed in claim 1 wherein a concave surface is disposed underneath said sliding block for stopping said protruded piece of said storage board.

* * * * *